US012257663B2

(12) United States Patent
Matsumoto et al.

(10) Patent No.: US 12,257,663 B2
(45) Date of Patent: Mar. 25, 2025

(54) REMOTE SURFACE TREATMENT SYSTEMS AND METHODS

(71) Applicant: GE-Hitachi Nuclear Energy Americas LLC, Wilmington, NC (US)

(72) Inventors: Jack T. Matsumoto, San Jose, CA (US); Nicholas F. Di Bari, San Jose, CA (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 1731 days.

(21) Appl. No.: 16/372,961

(22) Filed: Apr. 2, 2019

(65) Prior Publication Data

US 2020/0316746 A1 Oct. 8, 2020

(51) Int. Cl.
*B24B 29/02* (2006.01)
*B24B 47/22* (2006.01)

(52) U.S. Cl.
CPC ..... *B24B 29/02* (2013.01); *B24B 47/22* (2013.01)

(58) Field of Classification Search
CPC ..... B24B 15/00; B24B 15/02; B24B 41/002; B24B 41/02; B24B 41/005; B24B 23/08; B24B 5/06; B24B 5/40; B24B 27/0046; B24B 27/0015; B24B 27/0038; B24B 47/20; B24B 47/22
See application file for complete search history.

(56) References Cited

U.S. PATENT DOCUMENTS 766,713 A * 8/1904 Loetzer ..... B21D 51/2615
810,903 A * 1/1906 Blechschmidt ..... B24B 5/06
870,082 A * 11/1907 Chadwick ..... B24B 23/08 451/344
998,508 A * 7/1911 Hattersley et al. ..... B24B 5/06
(Continued)

FOREIGN PATENT DOCUMENTS

CN 2827630 10/2006
CN 110284381 A * 9/2019
(Continued)

OTHER PUBLICATIONS

O'Driscoll et al. "Choosing the Right Pneumatic Guided Drives and Slides". Nov. 4, 2020. <https://www.powermotiontech.com/technologies/other-components/article/21146797/choosing-the-right-pneumatic-guided-drives-and-slides>. (Year: 2020).*
(Continued)

*Primary Examiner* — Joel D Crandall
(74) *Attorney, Agent, or Firm* — Alley IP

(57) ABSTRACT

Systems remotely polish and compress surfaces for working, including surfaces created through electrical discharge machining. A bridge may secure about the surface and carry a spindle that rotatably extends downward and carries a polishing assembly. The polishing assembly can push against the surface while polishing the same with larger amounts of force. The polisher can be moved about a perimeter of the surface and vertically. Systems may be remotely operated with a pneumatic slide, hydraulic motor, and/or stepper motor. Spotfaces formed from electrical dis-
(Continued)

charge machining, including those in nuclear facilities and deep underwater, may have recast layers removed with such systems without manual or direct operator interface.

17 Claims, 4 Drawing Sheets

(56) References Cited

U.S. PATENT DOCUMENTS 1,662,137 A * 3/1928 Summers ..... B24B 41/002 451/157
1,933,677 A * 11/1933 Moore ..... B24B 15/00 451/902
2,521,210 A * 9/1950 Fulmer ..... B24B 23/08 451/135
2,694,278 A * 11/1954 Anderson ..... B24B 23/08 451/120
2,707,358 A * 5/1955 Grunder ..... B24B 23/08 451/441
2,720,736 A * 10/1955 McAfee ..... B24B 15/02 451/430
3,022,608 A * 2/1962 Tree ..... B24B 41/002 451/135
3,148,486 A * 9/1964 Gray ..... B24B 15/02 451/344
3,594,962 A * 7/1971 Christensson ..... B24B 15/00 451/431
3,663,188 A * 5/1972 Hoglund ..... B24B 19/095 451/239
3,800,621 A * 4/1974 Hoglund ..... B24B 19/095 74/567
3,805,456 A * 4/1974 Williams ..... B24B 55/04 451/259
3,816,996 A * 6/1974 Uhtenwoldt ..... B23Q 35/103 451/239
3,822,511 A * 7/1974 Hoglund ..... B24B 19/09 451/239
3,828,481 A * 8/1974 Uhtenwoldt ..... B24B 19/095 451/239
3,991,527 A * 11/1976 Maran ..... B24D 7/06 451/529
4,135,332 A * 1/1979 Theurer ..... E01B 31/17 451/72
4,205,495 A * 6/1980 Grimsley ..... B24B 15/02 451/430
4,338,961 A * 7/1982 Karpenko ..... B24B 15/02 74/25
4,485,517 A * 12/1984 Voigt ..... B08B 1/04 15/345
4,536,993 A * 8/1985 Shimizu ..... B24B 49/00 451/6
4,553,355 A * 11/1985 Smith ..... B24B 49/18 451/21
4,715,149 A * 12/1987 Kelsey ..... B24B 15/03 451/430
4,805,253 A * 2/1989 Hanser ..... B08B 1/04 15/88.4
4,934,012 A * 6/1990 Gemma ..... B08B 1/04 376/310
4,936,052 A * 6/1990 Nagase ..... B24B 7/005 451/127
5,687,205 A 11/1997 Matsumoto et al.
5,829,928 A * 11/1998 Harmand ..... B23Q 1/5456 451/430
5,895,311 A * 4/1999 Shiotani ..... B24B 19/14 451/504
9,821,428 B2 11/2017 Yoshikawa et al.
2002/0078541 A1* 6/2002 Ohmori ..... B23Q 7/02 29/563
2003/0128794 A1 7/2003 Kurosawa et al.
2004/0147208 A1* 7/2004 Takata ..... B24B 15/04 451/252
2010/0262289 A1* 10/2010 Hsu ..... G05B 11/42 700/254
2012/0003900 A1* 1/2012 Hudson ..... B24B 15/04 451/252
2015/0118939 A1* 4/2015 Andrews, Jr. ..... B24B 19/14 451/28
2016/0176015 A1* 6/2016 Naderer ..... B24B 49/006 451/21
2018/0243878 A1* 8/2018 Ulliman ..... B24B 9/007
2018/0361512 A1 12/2018 Lewis et al.

FOREIGN PATENT DOCUMENTS

JP 58-102042 7/1983
JP 06-134662 5/1994
JP 06-182662 7/1994
JP 08-197394 8/1996
JP 2005-342821 12/2005
JP 2013-202777 10/2013

OTHER PUBLICATIONS

EPO, Extended European Search Report in corresponding EP Application 20783698.2, Nov. 14, 2022.
WIPO, International Search Report in Corresponding PCT Application PCT/US2020/026381, Jul. 17, 2020.
WIPO, Written Opinion in Corresponding PCT Application PCT/US2020/026381, Jul. 17, 2020.
JPO, Office Action in corresponding JP application 2021-559065, Jan. 9, 2024.
JPO, Office Action in corresponding JP application 2021-559065, Jul. 9, 2024.

* cited by examiner

REMOTE SURFACE TREATMENT SYSTEMS AND METHODS

BACKGROUND

FIG. 1 is a cross-sectional view of a related art nuclear reactor 10 about a manway 11 in a shroud support, which is typically submerged deep under liquid coolant during reactor maintenance. During such maintenance, manway 11 may require repair or replacement of a cover, which may develop weld defect. As such, cutting out manway 11 and adding a bolted replacement manway cover may be executed during an outage to repair manway 11.

Cutting removes material from a bore edge, such as through electrical discharge machining, creating a precise and even hole 15 in manway 11. Because the affected area and cover may be large, hole 15 may need to be almost two feet in diameter d. Hole 15 may also be 1-3 inches deep, given the thickness of manway 11. The inner surface of hole 15 may thus be relatively large and may include a ledge or other variations to accommodate a repair or cover. For example, the inner surface of hole 15 may include bore 13 and spotface surface 14.

SUMMARY

Example embodiments include assembly systems for remotely treating surfaces with desired polishing and/or compression. Example embodiment systems include bridges to secure about the surface for treating. A rotatable spindle may extend downward from and be drivable from the bridge and include a polisher that moves, such as by spinning, in contact with the surface to be treated. The polisher further includes a biasing element that pushes it against the surface to impart compressive stresses, potentially up to several dozens pounds of force. The polisher may include a round filament brush. The spindle can rotate about another axis to move the polisher around a partial or entire perimeter of the surface to be treated. All of example embodiment systems may be remotely operated, and the various motions and biasing may be provided, simultaneously, by one or more drives in the bridge or polisher. The polisher may further be moveable vertically by such drives. For example, a pneumatic slide, hydraulic motor, and/or stepper motor may be used to remotely provide biasing and various rotations, respectively. Example embodiments are useable with spotfaces deep in nuclear reactors to remove a recast layer that may be formed following electrical discharge machining of the spotface and through bore, where manual or direct operator interface is not possible.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the terms which they depict.

Figure 4C:
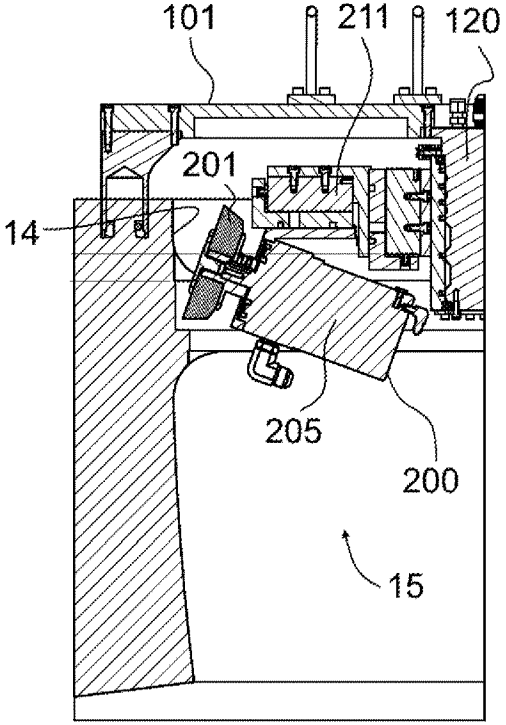
Figure 4B:
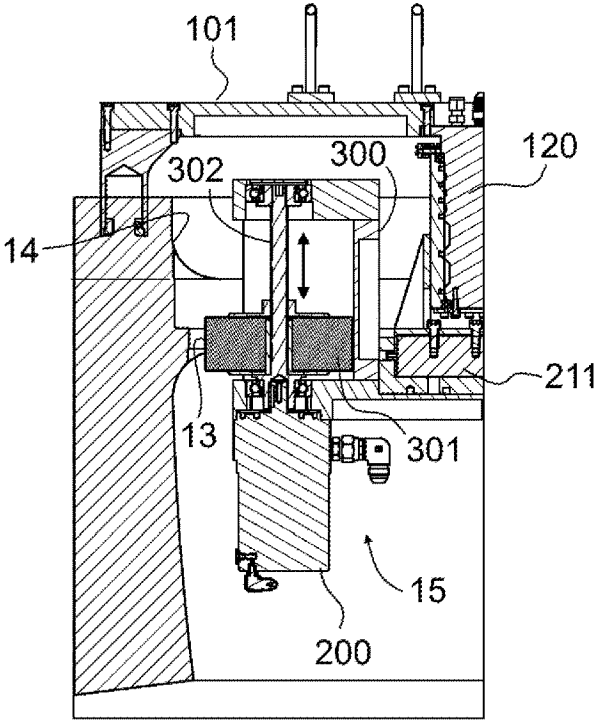
Figure 4A:
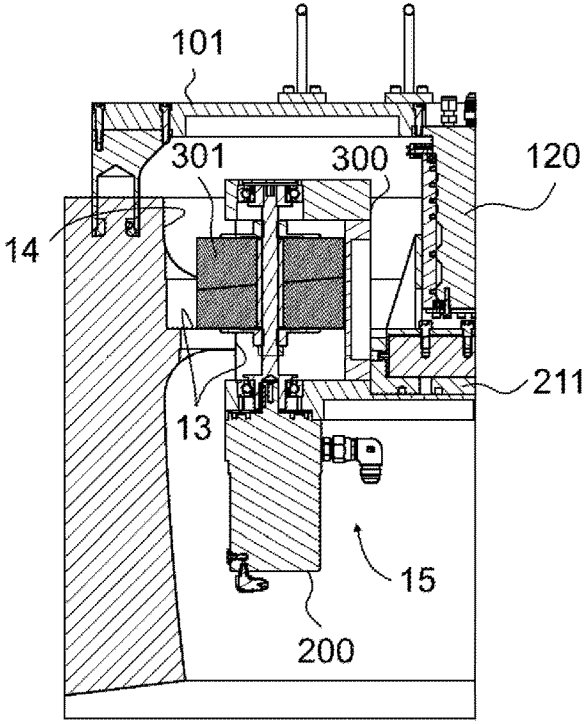

FIG. 4A is a cross-sectional schematic of an example embodiment bore polisher with a polishing assembly oriented vertically and mated with a bore polishing wheel. FIG. 4B is a cross-sectional schematic of the example embodiment bore polisher with the polishing wheel withdrawn lower vertically. FIG. 4C is a cross-sectional schematic of the example embodiment bore polisher with the polishing assembly disconnected from the bore polisher and rotated about several axes.

DETAILED DESCRIPTION

Because this is a patent document, general, broad rules of construction should be applied when reading it. Everything described and shown in this document is an example of subject matter falling within the scope of the claims, appended below. Any specific structural and functional details disclosed herein are merely for purposes of describing how to make and use examples. Several different embodiments and methods not specifically disclosed herein may fall within the claim scope; as such, the claims may be embodied in many alternate forms and should not be construed as limited to only examples set forth herein.

It will be understood that, although the ordinal terms "first," "second," etc. may be used herein to describe various elements, these elements should not be limited to any order by these terms. These terms are used only to distinguish one element from another; where there are "second" or higher ordinals, there merely must be that many number of elements, without necessarily any difference or other relationship. For example, a first element could be termed a second element, and, similarly, a second element could be termed a first element, without departing from the scope of example embodiments or methods. As used herein, the terms "and," "or," and "and/or" include all combinations of one or more of the associated listed items unless it is clearly indicated that only a single item, subgroup of items, or all items are present. The use of "etc." is defined as "et cetera" and indicates the inclusion of all other elements belonging to the same group of the preceding items, in any "and/or" combination(s).

It will be understood that when an element is referred to as being "connected," "coupled," "mated," "attached," "fixed," etc. to another element, it can be directly connected to the other element, or intervening elements may be present. In contrast, when an element is referred to as being "directly connected," "directly coupled," etc. to another element, there are no intervening elements present. Other words used to describe the relationship between elements should be interpreted in a like fashion (e.g., "between" versus "directly between," "adjacent" versus "directly adjacent," etc.). Similarly, a term such as "communicatively connected" includes all variations of information exchange and routing between two electronic devices, including intermediary devices, networks, etc., connected wirelessly or not.

As used herein, the singular forms "a," "an," and the are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof.

The structures and operations discussed below may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually or sequentially, to provide looping or other series of operations aside from single operations described below. It should be presumed that any embodiment or method having features and functionality described below, in any workable combination, falls within the scope of example embodiments.

As used herein, "axial" and "vertical" directions are the same up or down directions oriented along the major axis of a nuclear reactor, often in a direction oriented with gravity. "Transverse" and "horizontal" directions are perpendicular to the "axial" and are side-to-side directions oriented in a single plane at a particular axial height.

The Inventors have recognized that electrical discharge machining, as well as other material removal work, may leave a recast layer or a cold worked layer in the material being machined. This layer presents undesirable traits for interfacing with a cover or other repair, including material roughness and weakness. For machining in remote areas and/or underwater, such as in deep nuclear reactor repairs, it is infeasible to remove this layer with direct or hand tooling. The Inventors have further recognized that shot peening and/or laser treatment remotely may insufficiently remove the recast layer and not impart compression to strengthen and even the material. Lasers and shot peening may also be difficult to achieve in deep remote locations, especially in timely combination. Example embodiments described below uniquely enable solutions to these and other problems discovered by the Inventors.

The present invention is systems for remotely treating surfaces and methods of using the same in nuclear reactor spotfaces. In contrast to the present invention, the few example embodiments and example methods discussed below illustrate just a subset of the variety of different configurations that can be used as and/or in connection with the present invention.

Figure 2:
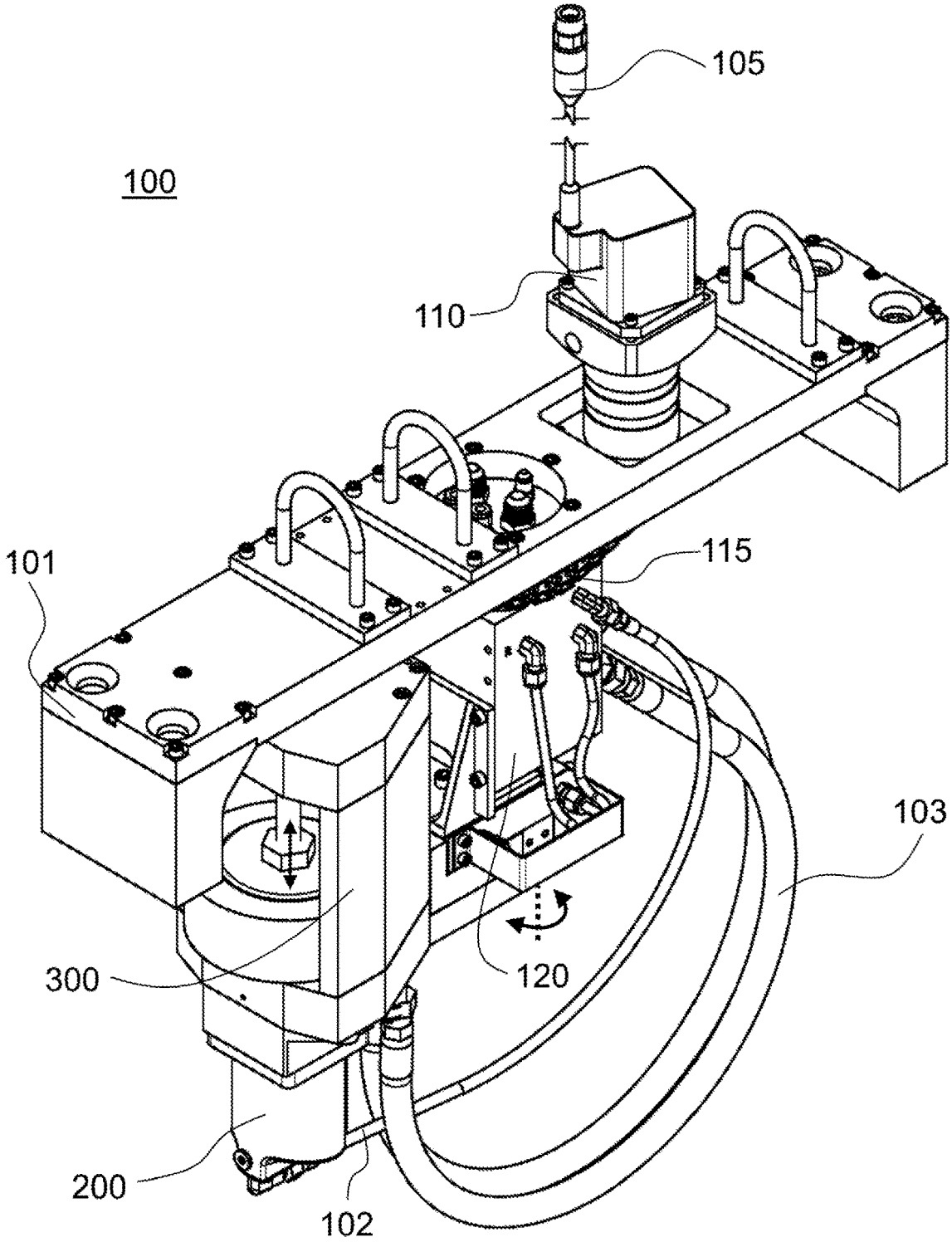
FIG. 2 is an illustration of an example embodiment bridge assembly.

FIG. 2 is an illustration of an example embodiment bridge assembly 100 configured to remotely position grinding and/or smoothing elements over a work surface. Although surfaces described in connection with example embodiments include bores and spotfaces deep underwater in reactors, it is understood that example embodiments are useable in connection with any type of surface requiring remote treatment, including pipe interiors, holding tanks or pools, access-restricted areas, etc. As shown in FIG. 2, bridge assembly 100 includes bridge 101 that may have a "U" shape with body and legs that allow positioning over, or separated from, a surface. Legs of bridge 101 may secure to or seat against a component having a surface, such as a spotface, to be treated. Anchoring (as shown in FIGS. 4A-C) may further be used as a securing device between legs of bridge 101 and the component. Bridge 101 may have other shapes and configurations that allow it to better fit to and/or access a surface to be worked.

Example embodiment bridge assembly 100 includes one or more drives to power various components, such as spindle 120 rotatable about a working surface. For example, bridge assembly 100 may include stepper motor 110 that rotates spindle 120 about bridge 101. Stepper motor 110 may connect to spindle assembly 120 via transmission 115, which may be a chain that meshes with a gear on spindle 120 in any desired ratio, such as a 2:1 ratio of rotation between stepper motor 110 and spindle 120. Similarly, a direct drive or any other type of powering may be used to rotate spindle assembly about a work surface. Spindle 120 may be rotationally seated in a middle of bridge 101 to permit full rotation of spindle 120 about a central vertical axis of bridge 101.

Motor 110, as well as other drives and devices in example embodiments, may be connected to controls, operators, data, and/or power through an umbilical connection 105. Alternatively, local power sources and wireless communications can be used to power and control example embodiments. Spindle 120 may connect to and power and/or control polishing assembly 200 and/or bore polisher 300 through connections 102 and 105. For example, connection 103 may carry a pneumatic line, electrical line, and/or data connection to power bore polisher 300, and connection 102 may carry hydraulic power, electricity, data, etc. to polishing assembly 200.

Through all these connections and power arrangements, example embodiment bridge assembly 100 may be positioned in remote areas, such as far into pipes or deep in flooded reactors, and operate with desired characteristics.

Figure 3:
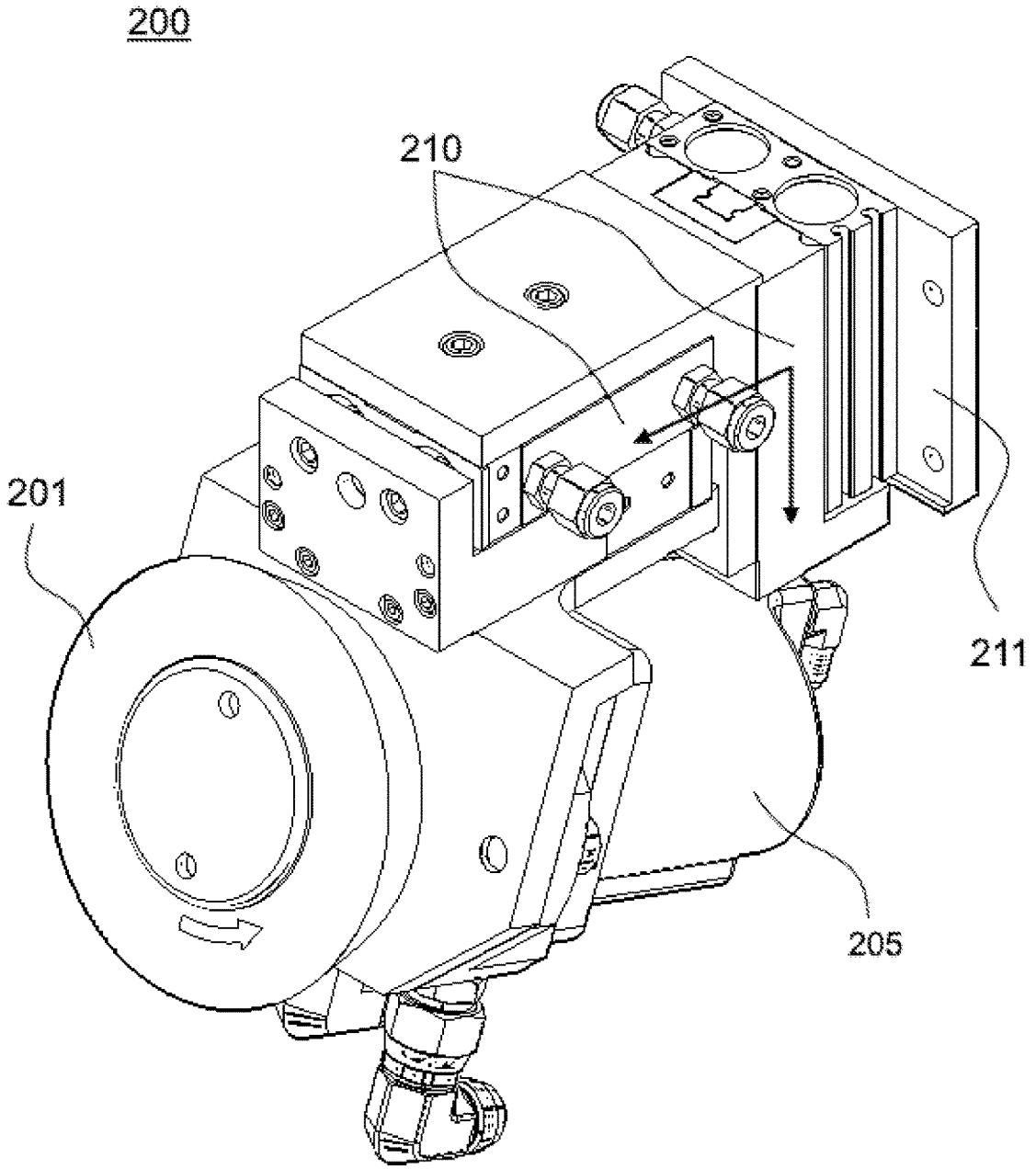
FIG. 3 is an illustration of an example embodiment polishing assembly.

Spindle 120 connects to desired toolings to work on surfaces under bridge assembly 100. For example, as shown in FIG. 2, polishing assembly 200 may be connected to and rotated by spindle 120. As shown in FIG. 3, polishing assembly 200 may include a polishing mount 211 that joins to spindle assembly 120 and connects a rotatable polishing surface 201, pneumatic slides 210 and hydraulic motor 205 to spindle 120 to carry the same. Polishing surface 201 is rotatable about a transverse or angled axis to polish and remove electrical discharge machining recast from surfaces it impinges. Pneumatic slides 210 may move motor 205 and polishing surface 201 in horizontal and vertical directions as shown in FIG. 3, to reach all surfaces in spotface 15, for example. Pneumatic slides 210 may supply a large amount of force directed along the internal rotation axis of polishing surface 201. For example, pneumatic slides 210 may expand between polishing mount 211 and polishing surface 201 for up to about 12 lbs. of force per ½-inch of width of the polishing surface. These higher levels of force, such as about 60-70 lbs. of force on a round polishing surface 201 of 5-6 inches, polish a larger recast layer and are sufficient to both remove the recast material and impart compressive stresses in most metallic surfaces. In a reactor shroud support, for example, this may be sufficient surface layer removal and compression to give a good working surface that it not subject to further degradation in the reactor.

Figure 1:
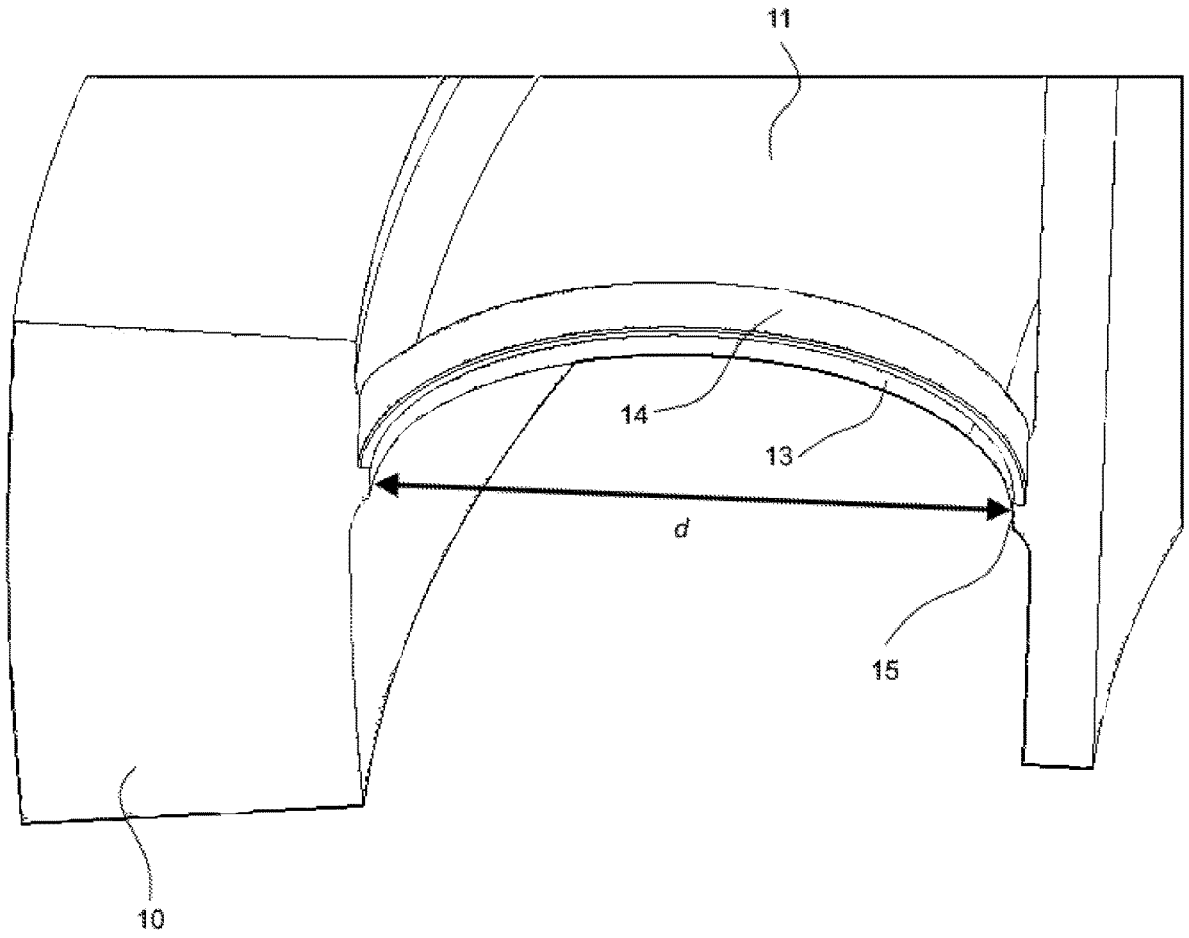
FIG. 1 is an illustration of a related art manway in a nuclear reactor.

Polishing surface 201 may be round, up to about 5.5 inches in diameter, for example, and driven angularly by hydraulic motor 205, which may have a separate or local power supply. Hydraulic motor 205 may be a positive displacement motor that can maintain a constant speed in polishing surface 201 even under heavier polishing pressures. For example, polishing surface 201 maybe driven at about 50 ft/s or more, or about 2000 rpm. Polishing surface 201 may use any abrasive of polishing material to achieve a desired surface finish, including, for example, an approximate 80 grit silicon carbide filament surface with about 30-40% grit load by weight. Polishing assembly 200 may position polishing surface 201 at approximately 10 degrees to spotface surface 14 (FIG. 1).

FIGS. 4A-C are illustrations of example embodiment polishing assembly 200 carried by example embodiment bridge assembly 100 in various configurations for polishing surfaces 13 and 14 of spotface 15, in an example method of preparing a nuclear reactor spotface for repair during a maintenance period. As shown in FIGS. 4A-C, bridge 101 may be mounted on a surface about spotface 15, which may be formed by electrical discharge machining. Polishing assembly 200 extends down into spotface 15 from spindle assembly 120 to contact surfaces 13 and 14 against polishing surface 201.

Polishing surface 201 may be rotated about its internal axis by hydraulic motor 205 or another drive in assemblies 100 and/or 200 with desired pressure and movement of the same. For example, spindle 120 may be rotated about its central axis by stepper motor 110 to, in turn, orbit or revolve polishing assembly 200 across a perimeter of spotface 15. In this way, polishing surface 201 may move along a continuous and entire spotface surface 14 and bore surface 13, removing a recast layer and compressing the same. Simultaneously, pneumatic slide 210 may expand to push polishing surface 201 from polishing support 211, providing desired polishing force or pressure.

In FIG. 4A, polishing assembly 200 is oriented vertically and mated with bore polishing wheel 301 in bore polisher 300. Pneumatic slides 210 (FIG. 3) may push assembly 200 in the vertical direction along axis 302 (FIG. 4B). In this position, polishing wheel 301 may polish bore surfaces 13 and 14 when wheel 301 is rotated about axis 302. In FIG. 4B, polishing wheel 301 is withdrawn lower vertically by pneumatic slides 201 along axis 302 to polish vertical sides of surface 13. In FIG. 4C, polishing assembly 200 is disconnected from bore polisher 300 and rotated about several axes to be brought into contact with spotface surface 14.

Hydraulic motor 205 and stepper motor 110 are of sufficient force to continue driving polishing surface 201, which may be rotating at thousands of rotations per minute, at these positions and pressures without being torqued out of position. All drives, including, for example, hydraulic motor 205, stepper motor 110, pneumatic slides 210, etc. may be locally or remotely powered through appropriate connections, and can further be controlled through, and relay data through, umbilical connection 105 (FIG. 2). The continuous surface-to-surface polishing achieved by rotation of polishing surface 201, pressure from pneumatic slide 210, and feed across surfaces 13 and 14 from rotation of spindle 120 can be achieved through combined operation of these components, removing all recast layer and supplying desired compression forces evenly throughout.

Example embodiment assemblies 100 and 200 may be fabricated of materials that are compatible with an operating nuclear reactor environment, including materials that maintain their physical characteristics when exposed to high-temperature fluids and radiation. For example, metals such as stainless steels and iron alloys, nickel alloys, zirconium alloys, etc. are useable in assembly components. Similarly, direct connections between distinct parts and all other direct contact points may be lubricated and fabricated of alternating or otherwise compatible materials to prevent seizing, fouling, or metal-on-metal reactions.

Example embodiments and methods thus being described, it will be appreciated by one skilled in the art that example embodiments may be varied and substituted through routine experimentation while still falling within the scope of the following claims. For example, any number of different surfaces can be polished by example embodiment assemblies, simply through proper dimensioning and positioning. Such variations are not to be regarded as departure from the scope of these claims.

What is claimed is:

1. A system for polishing a remote surface, comprising:
a bridge shaped to secure around the surface;
a spindle coupled to the bridge and rotatable about a first axis; and
a polishing assembly secured under the bridge to the spindle, wherein the polishing assembly includes a polishing surface rotatable about a second axis and the pneumatic slide configured to expand to force the polishing surface along the second axis.

2. The system of claim 1, wherein the pneumatic slide is configured to apply about 24 pounds of force per inch of width of the polishing surface.

3. The system of claim 1, wherein the polishing assembly further includes a hydraulic motor configured to rotate the polishing surface about the second axis.

4. The system of claim 3, wherein the hydraulic motor is configured to rotate the polishing surface at about 2000 rotations per minute.

5. The system of claim 1, wherein the bridge includes a stepper motor connected to the spindle and configured to rotate the spindle about the first axis relative to the bridge.

6. The system of claim 5, wherein the spindle is positioned in a middle of the bridge and extends below the bridge, and wherein the polishing assembly extends transversely from the spindle so as to reach a surface for polishing below the bridge.

7. The system of claim 1, wherein the polishing surface is rotatable to approximately 10 degrees from the horizontal by rotation of the polishing assembly.

8. The system of claim 1, wherein the polishing surface is about 80 grit silicon carbide.

9. The system of claim 1, wherein the polishing assembly is rotatable about the second axis 360 degrees below the bridge.

10. A system for polishing a remote surface, comprising:
a bridge; and
a polishing assembly configured to secure relative to the surface under the bridge, wherein the polishing assembly includes a first pneumatic slide, a second pneumatic slide, a motor, and a polishing surface, wherein,
the second pneumatic slide is configured to move the polishing surface across the remote surface in a first plane containing the polishing surface,
the polishing surface is moveable in a first direction perpendicular to the first plane by expansion of the first pneumatic slide to bias against the remote surface while moving across the remote surface in the first plane, and
the motor is configured to rotate the polishing surface about an axis internal to the polishing surface and passing through the bridge and polishing assembly to move across an entire perimeter of the remote surface.

11. The system of claim 10, wherein the first pneumatic slide is configured to apply about 24 pounds of force per inch of width of the polishing surface.

12. The system of claim 10, wherein the motor is a hydraulic motor configured to rotate the polishing surface about the second axis.

13. The system of claim 12, wherein the hydraulic motor is configured to rotate the polishing surface at about 2000 rotations per minute.

14. The system of claim 10, wherein the bridge includes a stepper motor configured to rotate the polishing assembly the first axis relative to the bridge.

15. The system of claim 10, wherein the polishing surface is rotatable to approximately 10 degrees from the horizontal by rotation of the polishing assembly.

16. The system of claim 10, wherein the polishing surface is about 80 grit silicon carbide.

17. The system of claim 10, wherein the polishing assembly is rotatable about the second axis 360 degrees below the bridge.

* * * * *